United States Patent [19]

Hodakowski et al.

[11] 4,212,899

[45] Jul. 15, 1980

[54] PROCESS FOR PRODUCING A COLORANT CONTAINING HIGHLIGHTED COATED SUBSTRATE

[75] Inventors: Leonard E. Hodakowski; Richard D. Jenkinson, both of St. Albans, W. Va.

[73] Assignee: Union Carbide Corporation, New York, N.Y.

[21] Appl. No.: 29,215

[22] Filed: Apr. 12, 1979

Related U.S. Application Data

[63] Continuation-in-part of Ser. No. 854,258, Nov. 23, 1977, abandoned.

[51] Int. Cl.[2] ..... B05D 3/06

[52] U.S. Cl. ..... 427/44; 427/54.1; 427/275

[58] Field of Search ..... 427/35, 275, 270, 54, 427/55, 264, 44; 428/161, 164, 159; 264/284

[56] References Cited

U.S. PATENT DOCUMENTS

| | | | |
|---|---|---|---|
| 3,345,234 | 10/1967 | Jecker et al. | 428/161 X |
| 3,518,153 | 6/1970 | Slosberg et al. | 428/164 X |
| 3,924,023 | 12/1975 | Boranian et al. | 427/54 |
| 3,992,276 | 11/1976 | Powanda et al. | 427/35 X |
| 4,100,318 | 7/1978 | McCann et al. | 428/159 |

*Primary Examiner*—Evan K. Lawrence
*Attorney, Agent, or Firm*—Stanley Ktorides

[57] ABSTRACT

A process for producing a colorant containing highlighted coated substrate by embossing the surface of the substrate, coating this entire surface of the embossed substrate with a radiation curable fluid coating composition containing from about 0.01 to about 15 weight percent colorant, exposing the coated substrate to ionizing or non-ionizing radiation to initiate the desired radiation cure of the coating, continuing to irradiate the substrate until the entire coating hardens, and recovering a coated substrate on which the coating follows the embossed surface and in which the recessed areas are highlighted with the colorant.

11 Claims, No Drawings

PROCESS FOR PRODUCING A COLORANT CONTAINING HIGHLIGHTED COATED SUBSTRATE

This application is a continuation-in-part of copending application, Ser. No. 854,258, filed Nov. 23, 1977, abandoned.

BACKGROUND OF THE INVENTION

1. Field of the Invention

This invention relates to a process for producing a colorant containing highlighted coated substrate by embossing the surface of a substrate to produce a recessed impression; coating this entire surface with a radiation curable fluid coating composition containing from about 0.01 to about 15 weight percent of colorant, this composition being capable of curing to form a hard layer adhering to said subtrate; exposing the coated substrate to ionizing or non-ionizing radiation to initiate the desired radiation cure of the coating, continuing to irradiate the coated substrate until the entire coating hardens, and recovering a coated substrate on which the coating follows the embossed surface and in which the recessed areas are highlighted with the colorant.

2. Description of the Prior Art

Radiation cured coatings are extensively used to enhance the appearance for floor covering and to provide the covering with resistance to staining, soiling from dirt, and the like. The floor covering is generally embossed with a pattern. An especially suitable coated floor covering is one in which the coating has been colored in order to bring out the highlights of the embossing. This effect has been created by registering a pattern on the substrate and then embossing it. This registering operation is quite costly and difficult to control.

SUMMARY OF THE INVENTION

A process has now been found for producing a colorant containing highlighted coated substrate which comprises the steps of:

a. embossing the surface of a substrate to produce on said substrate surface a recessed impression;

b. coating the entire surface of the embossed substrate with a radiation curable fluid coating composition containing from about 0.01 to about 15 weight percent of colorant, said composition being capable of curing to form a hard layer adhering to said substrate;

c. exposing the thus-coated substrate to ionizing or non-ionizing radiation to initiate the desired radiation cure of the coating;

d. continuing to irradiate said coated subtrate until the entire coating hardens; and e. recovering a coated substrate on which the coating follows the embossed surface and in which the recessed areas are highlighted with the colorant, eliminates the costly and difficult to control aforedescribed registering operation.

DETAILED DESCRIPTION OF THE INVENTION

The substrate to be embossed herein can be any material that can be deformed without qualitative internal structural change or fracture by the embossing roll. The preferred substrates are floor coverings such as, for example, vinyl or vinyl asbestos composites.

The embossing is performed by techniques well known in the art, such as by an engraved roll or cylinder.

The coating, of the substrate with the radiation curable fluid coating composition, can be applied by methods well known in the coating art by using such equipment as a reverse roll coater, direct roll coater gravure, rotary screen coater, flow (curtain) coater, etc.

The radiation curable fluid coating composition contains any of the suitable radiation reactive oligomers or resins as known to those skilled in the art.

As merely illustrative of suitable radiation reactive oligomers or resins one can mention:

(A) Polyurethane oligomers or polymers containing one or more acrylyl or methacrylyl groups. These can be prepared by reacting a hydroxyacrylate or hydroxymethyacrylate compound, such as 2-hydroxyethyl acrylate, 2-hydroxypropyl acrylate, 2-hydroxyethyl methacrylate, and the like, with an organic polyol and an organic polyisocyanate. Acrylate capped oligomers of this type are described in more detail in U.S. Pat. No. 29,131. The acrylate or methacrylate capped polyurethane oligomer can also typically be prepared by reacting a hydroxyl-terminated polyether acrylate or methacrylate, such as diethylene glycol monoacrylate, pentaerythritol mono-,di-, or tri-acrylate, or the corresponding methacrylates, with an organic polyisocyante, as discribed in U.S. Pat. No. 3,782,961. The acrylate capped polyurethane can also be an adduct of hydroxyalkyl acrylate or hydroxyalkyl methacrylate with an isocyanate-terminated urethane prepolymer which is prepared by reacting a stoichiometric excess of a polyisocyanate with an organic polyol, which polyol can be for example, a polycaprolactone polyol, polyoxyalkylene adipate polyol, polyoxytetramethylene polyol, poly(oxypropylene/oxyethylene) polyol, or the like.

(B) The acrylated or methacrylated derivatives of epoxidized fatty oils or fatty acids, such as described in U.S. Pat. Nos. 3,125,592; 3,224,989, and 3,256,225. Illustrative thereof one can mention acrylated expoxidized linseed, soybean, cottonseed, or hempseed oil, and the like.

(C) The reaction products of polyepoxides and acrylic anhydrides of monocarboxylic acids such as those described in U.S. Pat. No. 3,770,602.

(D) The reaction products of acrylic or methacrylic acid and polyfunctional epoxy resins such as the well known epichlorohydrin/bisphenol A type resins.

The above-mentioned oligomers or resins are intended to be merely illustrative of those useful in radiation curable coating compositions and are not intended to be all-inclusive.

The radiation reactive oligomer or resin, is present in the radiation curable coating compositions of this invention at a concentration of from 20 to 80 weight percent, preferably from 30 to 70 weight percent, based on the total weight of the coating composition.

If desired, there can also be present in the radiation curable coating compositions any of the polyfunctional monomeric acrylate or methacrylate compounds which are known to those skilled in the art to function as crosslinking agents in radiation curable coating compositions. The suitable polyfunctional monomeric acrylate or methacrylate compounds will be known to those skilled in the art without further elaboration herein. Nonetheless, one can mention, as being merely illustrative thereof, neopentyl glycol diacrylate, the diacrylate ester of 2,2-dimethyl-3-hydroxypropyl 2,2-dimethyl- 3hydroxypropionate, 1,3-butanediol diacrylate, ethylene glycol diacrylate, diethylene glycol diacrylate, triethylene glycol diacrylate, trimethylol propane triacrylate, 2-butene-1,4-diol diacrylate, 1,2,6-hexanetriol triacrylate, pentaerylthritol triacrylate, pentaerythritol tetracrylate, tripropylene glycol diacrylate, and the like, an adduct of two moles of a hydroxyalkyl acrylate compound such as 2-hydroxyethyl acrylate, with one mole of a diisocyanate such as tolylene diisocyanate, isophorone diisocynate, or dicyclohexylmethane 4,4'-diisocyanate, or the compounds obtained by substituting methacrylyl groups for any of the acrylyl groups of the foregoing compounds.

The polyfunctional monomeric acrylate or methacrylate crosslinking agent can be present in the radiation curable coating composition at a concentration of up to 50 weight percent, based on the total weight of the composition, and preferably, is present at a concentration of from 10 to 50 weight percent.

When non-ionizing radiation, e.g. ultraviolet, is to be used to cure the radiation curable coating compositions, there is a photoinitiator present in the composition. The photosensitizers which can be used are well known to those skilled in the art, as are the concentrations at which they are employed.

In addition to the above mentioned components, the radiation curable coating compositions of this invention can contain any other additives which are conventionally employed in radiation curable coating compositions of the prior art, such as wetting agents, flatting agents, slip additives, etc. and these are employed in the usual known effective concentrations.

Additionally, the radiation curable coating composition contains from about 0.01 to about 15 and preferably, from 0.05 to 5 weight percent of colorant. The colorant may be a dye or pigments or mixtures of these. The dyes which may be used herein are set forth in the *Encyclopedia of Polymer Science and Technology,* Volume 5, pages 376–403, John Wiley and Sons, New York (1966) while the pigments suitable for use herein are set forth in said *Encyclopedia of Polymer Science and Technology,* Volume 10, pages 157–192, which are incorporated herein by reference. The preferred colorants are the carbon blacks.

The radiation curable coating composition is produced by admixing the aforementioned components in any manner suitable for achieving a homogenous composition.

The substrate coated with the curable coating composition is exposed to ionizing or non-ionizing radiation to initiate curing, and the irradiation is continued until the entire coating hardens. The ionizing or non-ionizing radiation means include ultraviolet and electron beam radiation.

Irradiation is performed using any of the known and commonly available types of radiation curing equipment, for example, curing may be done by low, medium, or high pressure mercury lamps or electron beam or with a swirl-flow plasma arc radiation source by the process disclosed in U.S. Pat. No. 3,650,699. Curing can be carried out in an air atmosphere or in an inert gas atmosphere, such as nitrogen or argon. Exposure time required to cure the composition varies somewhat depending on the particular formulation, type and wavelength of radiation, and energy flux. Those skilled in the art of radiation technology will be able to determine the proper curing time for any particular composition. Generally, the cure time is rather short, that is, less than about 30 seconds.

The process of this invention produces an embossed substrate completely coated with a cured coating which follows the embossed pattern. The recessed areas are highlighted by the colorant in the coating.

The process of this invention has great utility in that costly processes such as those which require registration or lamination can now be avoided. Further by varying the amounts of colorant in the radiation curable coating, one can produce unique and attractive effects without costly alteration procedures.

It was completely unexpected and unobvious to find that by completely coating an embossed substrate with a colorant-containing radiation curable coating such that the coating follows the embossed pattern, there would result a coated substrate, highlighted in the recessed areas by the colorant, which is comparable in quality and beauty to color highlighted substrates produced by far more complicated and costly processes. This highly advantageously result could not have been predicted.

The following examples are merely illustrative of the present invention and are not intended as a limitation in the scope thereof.

EXAMPLE 1

A vinyl asbestos tile having a thickness of 80 mils was embossed with a conventional embossing roll so as to form a recessed impression on the tile.

A pigmented curable coating composition was produced containing a mixture of:

(a) 100 parts by weight of a mixture containing: 57.8 parts of the reaction product of one mole of a polycaprolactone diol having an average molecular weight of 530 and an hydroxyl number of 212, two moles of isophorone diisocyanate and two moles of 2-hydroxyethyl acrylate (produced according to the method as set forth in U.S. Pat. No. 29,131 which is incorporated herein by reference); 13.5 parts of 2-ethylhexyl acrylate; 17 parts of phenoxyethyl acrylate; 1 part of diethoxyacetophenone; and 10.2 parts of the reaction product of 1 mole of isophorone diisocyanate and 2 moles 2-hydroxyethyl acrylate;

(b) 0.5 parts of weight of black dye.

The resin and dye were stirred with an air stirrer to disperse the dye.

The coating composition was charged to a 24-inch Black Brothers Direct Rool coater having the following settings:

Coating speed set: 1.0
Compression, mils: 10.0
Nip, mils: 4.0
Roll hardness: 35A The vinyl asbestos tile was preheated to 40° C. and then passed through the coater and coated with 2.8 mils of the radiation curable coating. This tile was then cured for 1.9 seconds in a 12-inch wide curing unit, containing three 100 watt per inch medium pressure mercury bulbs. U.V. flux was 500 watts per square foot and running speed was 75 feet per minute.

The coated vinyl asbestos tile so produced exhibited a coating which followed the embossed surface and exhibited highlighted embossing.

EXAMPLE 2

A vinyl asbestos tile having a thickness of 80 mils was embossed with a conventional embossing roll so as to form a recessed impression in the tile.

A pigmented radiation curable coating composition was produced containing a mixture of:

(a) 100 parts by weight of a mixture containing 59.2 parts of the reaction product of one mole of a polycaprolactone diol having an average molecular weight of 530 and an hydroxyl number of 212, two moles of isophorone diisocyanate and two moles of 2-hydroxyethyl acrylate; 17.4 parts of phenoxyethyl acrylate; 12 parts 2-ethylhexyl acrylate and 10.4 parts of the reaction product of 0.1 mole of isophorone diisocyanate and 2 moles of 2-hydroxyethyl acrylate; 1 part of diethoxy acetophenone;

(b) 0.05 parts by weight of carbon black (Neo Spectra Mark II powder manufactured by Columbia Carbon Co.)

The carbon black was disperded in 2-ethylhexyl acrylate on a pebble mill and then added to the resin and rolled until homogeneous.

The coating composition was charged to a Pressure Head Flow Coater having the following settings:

Operating Temp. °C.: 55
Coating Speed, linear ft./min.: 325
Pump pressure, psi: 0.25
Die gap setting: 6.0
Head height, in.: 8.0

The vinyl asbestors tile was coated with 4 mils of the coating composition and then cured by the procedure set forth in Example 1. The coated tile so produced exhibited a coating which followed the embossed surface and exhibited a highlighted effect.

EXAMPLE 3

A vinyl asbestos tile having a thickness of 80 mils was embossed with a conventional embossing roll so as to form a recessed impression on the tile.

A pigmented curable coating composition was produced containing a mixture of:

(a) 100 parts by weight of a mixture containing: 62 parts of the reaction product of one mole of a polycaprolactone diol having an average molecular weight of 530 and an hydroxyl number of 212, two moles of isophorone diisocyanate and two moles of 2-hydroxyethyl acrylate (produced according to the method as set forth in U.S. Pat. No. 29,131, which is incorporated herein by reference); 8 parts of 2-ethylhexylacrylate; 7 parts of hydroxyethyl acrylate; 1 part of dibutoxyacetophenone; 20 parts of methylcarbamoyloxyethyl acrylate and 7 parts of the diacrylate ester of 2,2-dimethyl-hydroxypropyl, 2,2-dimethylhydroxypropionate;

(b) 0.5 parts by weight of black dye;

(c) 3.0 parts by weight of silica.

The resin and dye were stirred with an air stirrer to disperse the dye. The silica was added and the mixture stirred at high speeds for about 15 minutes.

This coating composition was charged to a 24 inch Black Brothers Direct Roll coater having the following settings:

Coating speed set: 2.0
Compression, mils: 10.0
Nip, mils: 2.0
Roll hardness: 35A The vinyl asbestors tile was passed through the coater and coated with 3.5 mils of the radiation curable coating. This tile was then cured by the procedure set forth in Example 1.

The coated vinyl asbestos tile so produced exhibited a coating which followed the embossed surface and exhibited highlighted embossing.

EXAMPLE 4

A vinyl asbestos tile having a thickness of 80 mils was embossed with a conventional embossing roll so as to form a recessed impression in the tile.

A pigmented radiation curable coating composition was produced containing a mixture of:

(a) 100 parts by weight of a mixture containing 47.5 parts of the reaction product of one mole of a polycaprolactone diol having an average molecular weight of 530 and an hydroxyl number of 212, two moles of isophorone diisocyanate and two moles of 2-hydroxyethyl acrylate; 45 parts of methylcarbamoyloxy ethyl acrylate; 1 part of dibutoxy acetophenone and 0.5 parts of

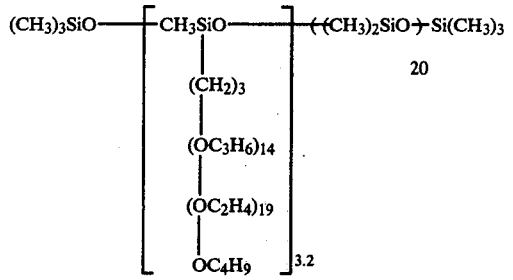

(b) 0.05 parts by weight of carbon black (Neo Spectra Mark II powder manufactured by Columbia Carbon Co.)

The carbon black was dispersed in 2-ethylhexylacrylate on a pebble mill and then added to the resin and rolled until homogeneous.

The coating composition was charged to a Pressure Head Flow Coater having the following settings:

Operating Tem. °C.: 38
Coating Speed, linear ft./min: 400
Pump pressure, psi: 0.1
Die gap setting: 5.0
Head height, in: 8.0

The vinyl asbestos tile was coated with 4 mils of the coating composition and then cured by the procedure set forth in Example 1. The coated tile so produced exhibited a coating which followed the embossed surface and exhibited a highlighted effect.

What is claimed is:

1. A process for producing a colorant-containing highlighted coated substrate which comprises the steps of:

a. embossing the surface of a substrate to produce on said substrate surface a recessed impression;

b. coating the entire surface of the embossed substrate with a radiation curable fluid coating composition comprising from 20 weight percent to 80 weight percent of radiation reactive oligomer or resin, from 0 weight percent to 50 weight percent of a polyfunctional monomeric acrylate or methacrylate crosslinking agent and from 0.01 to about 15 weight percent of colorant, such that the coating composition follows the embossed surface, said composition being capable of curing to form a hard layer adhering to said substrate;

c. exposing the thus-coated substrate to ionizing or non-ionizing radiation to initiate the desired radiation cure of the coating;

d. continuing to irradiate said coated substrate until the entire coating hardens; and e. recovering a coated substrate on which the coating follows the embossed pattern and in which the recessed areas are highlighted with the colorant.

2. The process of claim 1, wherein the substrate is a vinyl tile.

3. The process of claim 1, wherein the substrate is vinyl asbestos tile.

4. The process of claim 1, wherein said oligomer or resin is a polyurethane.

5. The process of claim 1, wherein said oligomer or resin is an acrylated derivative of epoxidized fatty oil or fatty acid.

6. The process of claim 1, wherein the coating contains from about 0.01 to 5 weight percent of colorant.

7. The process of claim 1, wherein the colorant is a dye.

8. The process of claim 1, wherein the non-ionizing radiation is ultraviolet light.

9. The process of claim 1, wherein the radiation is an electron beam.

10. The process of claim 1, wherein the colorant is a pigment.

11. The process of claim 10, wherein the pigment is carbon black.

* * * * *